US007080757B2

(12) United States Patent
Cuisinier

(10) Patent No.: US 7,080,757 B2
(45) Date of Patent: Jul. 25, 2006

(54) TOY WATER GUN

(76) Inventor: Jarret Peter Cuisinier, 6730 E. Hermosa Vista Dr. #74, Mesa, AZ (US) 85215

( * ) Notice: Subject to any disclaimer, the term of this patent is extended or adjusted under 35 U.S.C. 154(b) by 300 days.

(21) Appl. No.: 10/640,509

(22) Filed: Aug. 12, 2003

(65) Prior Publication Data

US 2005/0035147 A1 Feb. 17, 2005

(51) Int. Cl.
*A63H 3/18* (2006.01)

(52) U.S. Cl. ..... 222/79; 222/212; 222/465.1; 222/565

(58) Field of Classification Search ..... 222/78, 222/79, 212, 282, 287, 465.1, 482, 565
See application file for complete search history.

(56) References Cited

U.S. PATENT DOCUMENTS 1,394,456 A 10/1921 Wanat
3,481,510 A * 12/1969 Allen, Jr. ..... 222/79
4,492,318 A * 1/1985 Luk ..... 222/79
4,733,799 A 3/1988 Wiskur
5,865,438 A * 2/1999 Zilliox ..... 273/349
5,915,628 A * 6/1999 Kreizel ..... 239/377
5,928,053 A 7/1999 Henderson
5,992,697 A * 11/1999 James ..... 222/175
2002/0079339 A1* 6/2002 Sheffler et al. ..... 222/480
2003/0010795 A1* 1/2003 Duqueroie ..... 222/212
2004/0164090 A1* 8/2004 Eddins et al. ..... 222/39
2005/0023294 A1* 2/2005 Durant et al. ..... 222/129

* cited by examiner

*Primary Examiner*—Joseph A. Kaufman

(57) ABSTRACT

The present invention provides a simple, inexpensive, and reliable toy water gun configuration for launching a blast of water. For example, the water gun has a reservoir for storing fluid and a nozzle for expelling fluid. A user then propels the water from the reservoir down a neck and towards the nozzle via a motion applied to the entire water gun. The water then exits the gun through the nozzle in a blasting form.

20 Claims, 6 Drawing Sheets

TOY WATER GUN

FIELD OF INVENTION

This invention relates to children entertainment devices, and more particularly, to children entertainment devices such as toy water guns.

BACKGROUND OF THE INVENTION

A variety of water gun devices have been described in the prior art. These devices have configurations ranging from manual piston pumps, which dispel a pump chamber's fluids when compressed, to pressurized systems, which typically use a pumping means to pressurize a water-containing chamber that will later be dispelled. Furthermore, water gun embodiments using electrical pumps have also been described in the prior art.

These configurations have a number of innate problems because of their inherent complexity. The first and most notable of these is the considerable cost associated with the manufacturing of such intricate configurations. The large number of parts and their extensive time of assembly can often lead to substantially higher costs. As a general rule, these configurations' greater number of parts directly leads to greater costs.

In addition, this inherent complexity can also lead to an increased likelihood of mechanical failure. For example, pressurized systems commonly have difficulties with pump jams, part breaks, and the like. Meanwhile, devices relying on electrical pumps can have numerous troubles and reliability issues relating to the electrical motors they depend on. All of these difficulties can significantly reduce the overall quality of use.

Finally, such complexity can augment complexity of use and further detract from the overall enjoyment of the user. For example, pressurized squirt guns often require numerous pumping motions to pressurize the chamber before any water can be dispelled. This activity can be both exhausting and irritating during repeated use. Similarly, devices using electrical power often require new batteries in order to be used. This dependency can be another irritating factor as well as an additional cost associated with such complex configurations.

The water gun prior art is also limited in its capability to issue a broad blast of water. Such a water blast is often preferable because of its dense shooting area and lessened need for aiming—a wide-range blast of water can easily soak a person with one shot. Thus far, the prior art has primarily disclosed configurations for dispelling a stream, often steady, of fluid from a nozzle. However, in many cases, for the previously mentioned reasons, it is preferable to launch a broad, splattering blast of water.

Accordingly, a simple, inexpensive, and reliable water gun configuration that does not require numerous parts or a complicated method of use is desirable. In addition, a water gun that aptly delivers a dense blast of water is as well desirable.

SUMMARY OF THE INVENTION

The present invention provides a simple, inexpensive, and reliable toy water gun configuration for launching a blast of water. In accordance with an exemplary embodiment of the present invention, water is stored in a reservoir. A user then propels the water from the reservoir down a narrowing neck and towards a nozzle via a motion applied to the entire water gun. The water then exits the gun through the nozzle in a blasting form.

BRIEF DESCRIPTION OF THE DRAWINGS

Additional aspects of the present invention will become evident upon reviewing the non-limiting embodiments described in the specification taken in conjunction with the accompanying figures, wherein like numerals designate like elements, and.

DETAILED DESCRIPTION

The following descriptions are of preferred exemplary embodiments only, and are not intended to limit the scope, applicability, or configuration of the invention in any way. Rather the following description provides a convenient illustration for implementing a preferred embodiment of the invention. Various changes may be made in the function and arrangement of elements described in the preferred embodiments without departing from the spirit and scope of the invention as set forth herein.

Generally, in accordance with a preferred embodiment of the present invention, a water gun is provided for releasing a blast of water. The device is suitably configured to make a water blast via a motion applied to the entire water gun. More particularly, the motion creates a momentum in the volume of the fluid of the gun, which in turn may be used to create a pressure differential in the vicinity of a nozzle. For example, in a preferred embodiment, this configuration suitably eliminates the need for integrated pumps and pressurized chambers, and instead allows a user to easily launch a blast of water from a simple device. For example, water may be contained in a reservoir. A user can then propel the water from the reservoir down a narrowing neck and toward a nozzle via a quick forward and backward motion along the device's axis. The water then exits the gun through the nozzle in a blasting form. Thus, it should be appreciated that any number of movements that create a momentum can be used while still falling within the scope of the present invention.

Additionally, in accordance with one aspect of the present invention, the water gun could be suitably configured to additionally possess a controller for regulating the flow of exiting water through the nozzle. For example, a trigger mechanism could be used in combination with the nozzle to provide the user with full control over when water would exit the water gun.

Figure 1A:
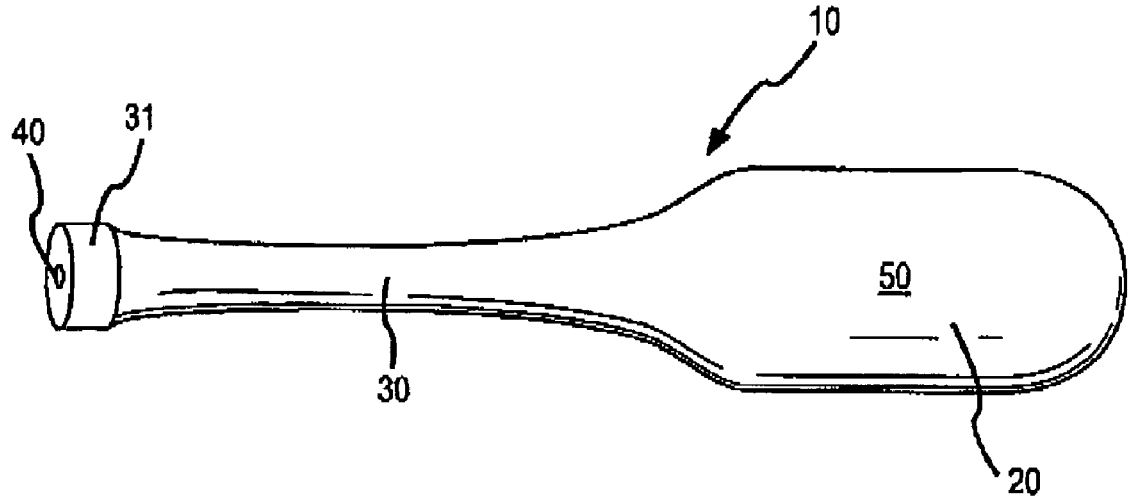
FIG. 1*a* is an exterior side view of an exemplary embodiment of the water gun.
Figure 1B:
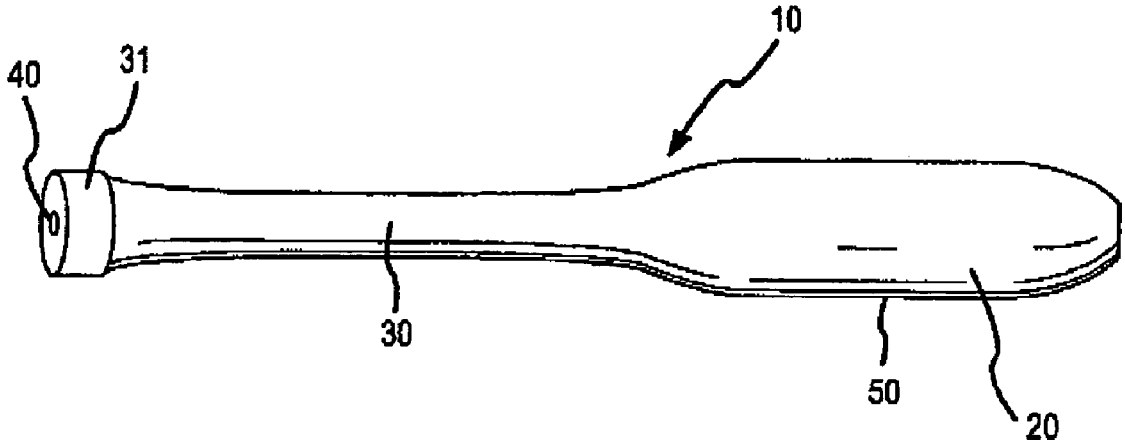
FIG. 1*b* is an exterior top view of an exemplary embodiment.

Thus, with reference to FIG. 1*a* and FIG. 1*b*, in accordance with an exemplary embodiment of the present invention, a water gun 10 is shown having a reservoir 20, a neck 30, a nozzle 40, and a pressure normalizer 50. In accordance with the present exemplary embodiment, reservoir 20, neck 30, nozzle 40, and pressure normalizer 50 are made of a polymer. However, in accordance with various alternate embodiments reservoir 20, neck 30, nozzle 40, and pressure normalizer 50 could be substituted with alternative materials including composites, metals, and the like. Furthermore and still in accordance with the present exemplary embodiment, reservoir 20, neck 30, nozzle 40, and pressure normalizer 50 are integrated into one consolidated piece, all composed of the same polymer material. However, in accordance with alternate embodiments, reservoir 20, neck 30, nozzle 40, and pressure normalizer 50 could be separate parts and composed of different materials. Moreover, in accordance with various alternate embodiments, the size, shape, and number of reservoir 20, neck 30, nozzle 40, and pressure normalizer 50 could as well vary. Additionally, complete water gun 10 can be integrated and used in combination with any number of identical or different toy gun configurations.

With continuing reference to FIG. 1*a* and FIG. 1*b*, reservoir 20 is of sufficient size to carry ample amounts of a fluid 60 for multiple firings. Additionally, neck 30 is preferably smaller in width than reservoir 20 so as to better direct and compress fluid 60 towards nozzle 40 during use. Moreover, nozzle 40 has a diameter sufficient to release a predetermined amount of fluid 60 as fluid 60 impacts an end 31 of neck 30 during use. In addition, and again in accordance with one aspect of the present exemplary embodiment, pressure normalizer 50 is present as semi-pliable walls of reservoir 20. These semi-pliable walls allow reservoir 20 to cave in slightly with the exiting of fluid 60 through nozzle 40, thereby reducing the overall volume of reservoir 20 and counteracting the resulting vacuum and pressure change. After use, air can than enter reservoir 20 via nozzle 40 and thereby completely neutralize the pressure in reservoir 20, allowing the walls of reservoir 20 to return to their original, uncollapsed positions. However, and in accordance with an alternate embodiment of the invention, pressure normalizer 50 is a one-way valve letting air enter reservoir 20 as fluid 60 exits through nozzle 40, thereby effectively neutralizing vacuums in reservoir 20. Furthermore, neck 30 and reservoir 20 may be covered with an aesthetic housing (not shown). Preferably, such aesthetic housing is translucent so as to let the user view the internal workings of water gun 10.

Figure 2:
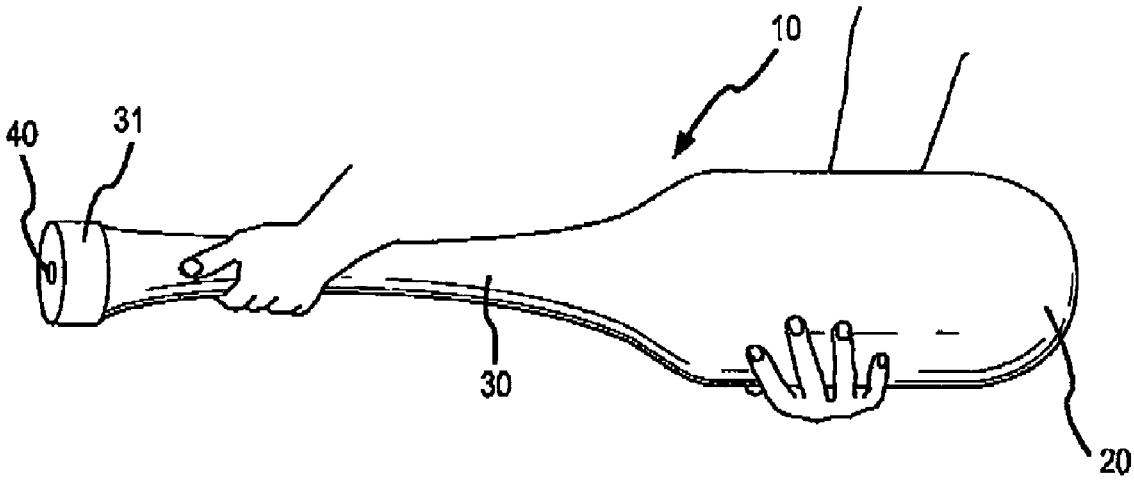
FIG. 2 is an exterior side view of an embodiment illustrating how a user would properly hold the device.
Figure 3A:
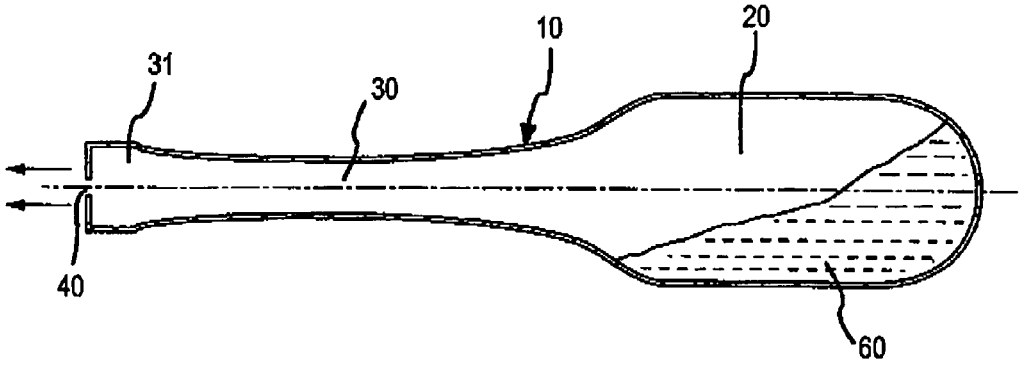
FIG. 3*a* is a cross-sectional side view of an embodiment in use during a "cocking" motion.
Figure 3B:
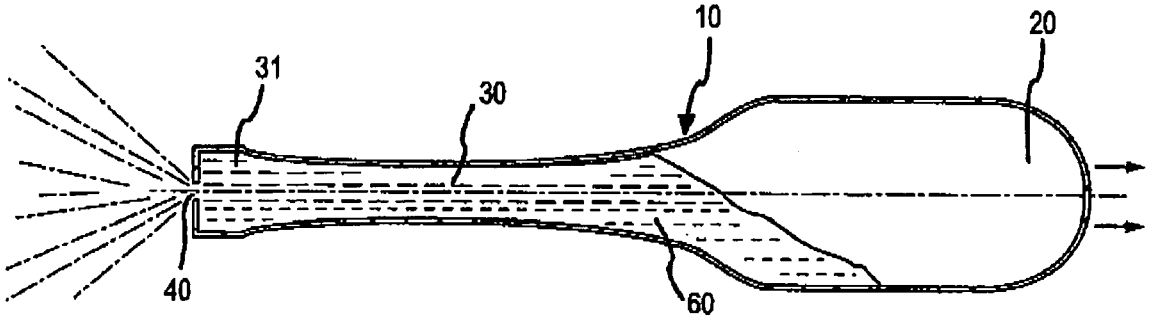
FIG. 3*b* is a cross-sectional side view of an embodiment in use during a "firing" motion.

Thus, in accordance with the present exemplary embodiment of the invention and now in reference to FIG. 2, a user can launch fluid 60 from water gun 10 through a motion. In use, with respect to the present exemplary embodiment, reservoir 20 is filled with fluid 60 through nozzle 40 by submersion in a large body of water (e.g. pool) or through the use of a faucet. Once full, entire water gun 10 is picked up and held as depicted in FIG. 2—one hand typically grasping neck 30 and the other hand holding reservoir 20. Water gun 10 is then slowly moved forward along the lengthwise axis of neck 30 with end 31 leading. This motion represents the "cocking" motion and gives entire fluid 60 forward momentum (see FIG. 3*a*). Immediately following this cocking motion the user quickly pulls water gun 10 in the reverse direction along the axis of neck 30, now with reservoir 20 leading. This motion represents the "firing" motion and quickly propels fluid 60 down neck 30 towards end 31 and launches a portion of fluid 60 through nozzle 40 in blasting nature (see FIG. 3*b*). This spray provides a dense barrage of fluid that then drenches the user's target. Furthermore, the user can repeat this series of motions as often and as quickly as desirable, thereby letting him or her repeatedly and rapidly create dense blasts of fluid.

Figure 4:
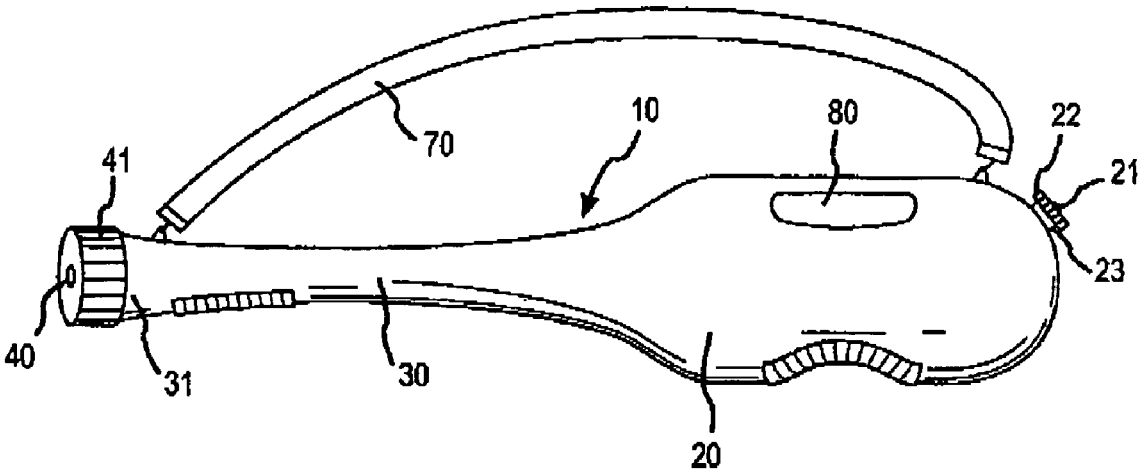
FIG. 4 is an exterior side view of a preferred embodiment incorporating multiple nozzles, a separate fill lid with integrated one-way valve, a harness, and a handle.

Now with reference to FIG. 4, a preferred embodiment of the invention is shown. This embodiment incorporates various supplementary features intended to optimize the overall use of the invention for the user. However, various alternate embodiments of the present invention may omit some or all of these features, utilize another combination of these features, or utilize these and additional features not here described.

In accordance with one aspect of a preferred embodiment of the invention, pressure normalizer 50 is a one-way valve and is present at the top of reservoir 20. One-way valve pressure normalizer 50 lets air enter reservoir 20 and neutralizes the vacuum generated during use as fluid 60 escapes through nozzle 40. Preferably, one-way valve pressure normalizer 50 is resisted so as to minimize unintentional loss of fluid 60 through nozzle 40 by only allowing air to enter reservoir 20 when the pressure within reservoir 20 is substantially less than the outside air pressure (i.e. during a "firing" motion). However, and in accordance with an alternate embodiment of the invention, pressure normalizer 50 is a simple hole so as to effectively neutralize all vacuums in reservoir 20. However, in accordance with various alternate embodiments, pressure normalizer 50 may instead be composed of a combination of holes, pliable reservoir 20 walls, one-way valves, or the like. This "combination" pressure normalizer 50 collectively neutralizes resulting vacuums within reservoir 20.

In accordance with another aspect of a preferred embodiment of the invention, a filling lid 22 is located on an orifice 23 of reservoir 20. Orifice 23 effectively provides an easy means for filling reservoir 20 with a faucet, hose, bucket, or the like. Moreover, filling lid 22 preferably screws tightly on orifice 23 thereby providing an airtight seal. In this embodiment, one-way valve 21 is preferably integrated into filling lid 22. However, and again in accordance with various alternate embodiments, water gun 10 could be further adapted to be used with various "quick-fill" means now known or not yet known for the quick filling of water guns with fluid.

Figure 5:
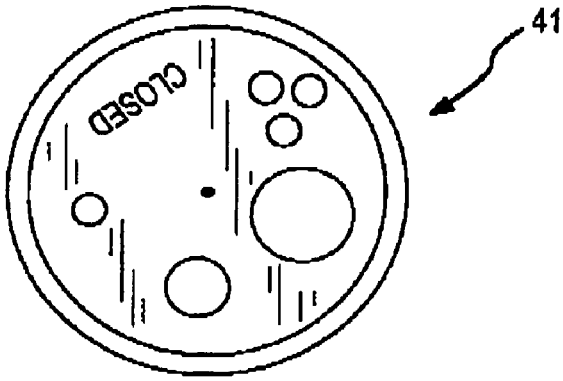
FIG. 5 is an exterior front view of the nozzle system used with a preferred embodiment.

Additionally, and in accordance with another aspect of a preferred embodiment, a rotatable nozzle system 41 lies over basic nozzle 40. Rotatable nozzle system 41 possesses multiple nozzle varieties allowing the user to control the amount of fluid 60 exiting through nozzle 40 during use. For example, nozzle system 41 could possess a small, medium, and large nozzle as well as a nozzle with a collection of three holes (see FIG. 5). Furthermore, nozzle system 41 also possesses a "closed" position that seals nozzle 40 and stops fluid 60 from exiting. This "closed" position is ideal during inactivity, filling, or loaded storage of water gun 10. Additionally, nozzle system 41 may also possess various other nozzle configurations (e.g. a double-function large diameter "fill"/shooting nozzle, a focusing stream nozzle, a nozzle system with continuous diameter settings, and the like) and combinations now known or not yet known in the prior art. In addition, in accordance with an alternative embodiment of the invention, a resisted valve (not shown) covers nozzle 40. This resisted valve only allows strong fluid flow, such as that produced during a "firing" motion, to exit nozzle 40 and thereby prevents unintentional loss of fluid 60. This resisted valve at nozzle 40 can as well be used with a similar nozzle system 41.

In addition, and in accordance with another aspect of a preferred embodiment, a carrying strap 70 is attached to water gun 10 for easier overall transport and use. Carrying strap 70 preferably attaches near end 31 and the end of reservoir 20. Likewise, a handle 80 is integrated into water gun 10 to similarly make overall transport and use easier.

Figure 6:
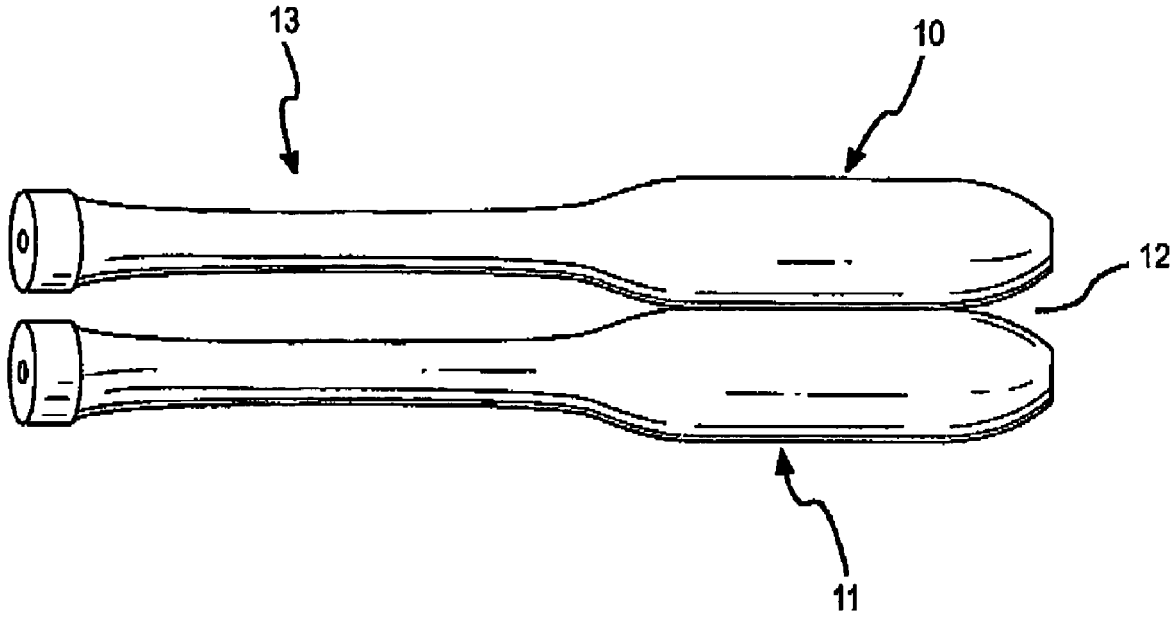
FIG. 6 is an exterior top view of a connected lockable, two-gun system.

Referring now to FIG. 6, in accordance with another alternative embodiment of the present invention, a multi-gun embodiment is shown. A second water gun 11 is presented possessing a similar configuration as water gun 10. Furthermore, water gun 10 and second water gun 11 possesses a connector 12. For example, connector 12 could be a sliding male/female locking mechanism or another locking mechanism already described in the prior art. Thus, water gun 10 and second water gun 11 can be connected and used in parallel via connector 12, creating a double-barrel water gun 13, or used as separate water gun 10 and second water gun 11, providing the user with multiple guns.

Figure 7A:
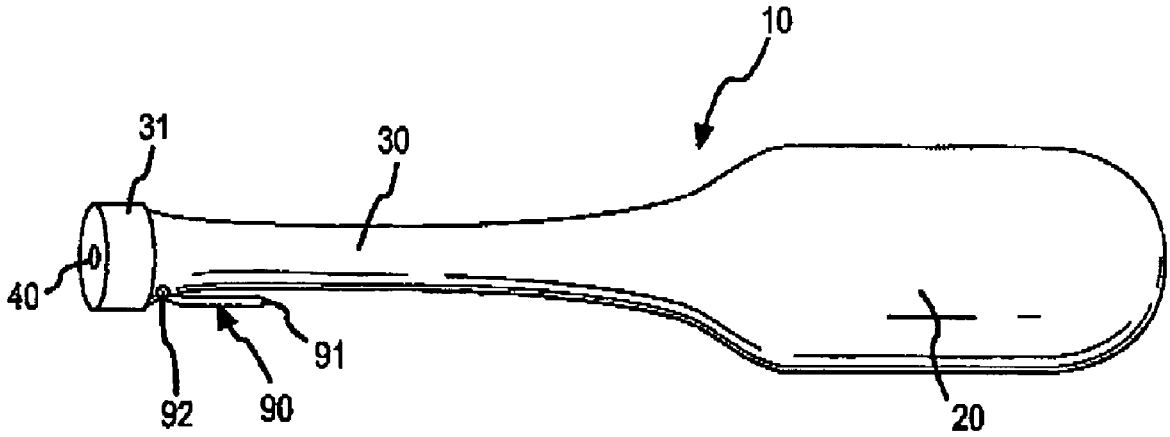
FIG. 7*a* is an exterior side view of an embodiment using an exemplary controller; and, FIG. 7*b* is a cross-sectional side view of such an exemplary controller.

Now with reference to FIG. 7*a* another alternate embodiment of the invention is presented. In accordance with the present embodiment of the invention, a configuration utilizing a lever-based controller 90 is presented. Controller 90 allows the user to effectively control the flow of water through nozzle 40 and can be present in a variety of configurations. For example, and in accordance with an alternate embodiment of the present invention, controller 90 could also be present as a spring-mounted, rotatable system. For example, controller 90 could be located on neck 30 and rotated about neck 30 so as to open nozzle 40 in a similar manner as nozzle system 41. When the user releases controller 90, the spring returns controller 90 to its closed position, thereby effectively regulating the flow of water through nozzle 40. Furthermore, such a rotatable nozzle system could as well be used in combination with a nozzle system 41. In fact, controller 90 and nozzle system 41 could be integrated. For example, entire rotatable nozzle system 41 could similarly be spring mounted so as to automatically return to a closed nozzle position when the user released nozzle system 41. In addition, and now in accordance with yet another alternate embodiment of the present invention, controller 90 could regulate the flow of air through pressure normalizer 50 (hole or one-way valve varieties). Thus, controller 90 could thereby indirectly control the ability of fluid 60 to exit water gun 10 through nozzle 40. Additionally, in accordance with an alternate embodiment, controller 90 could be used in combination with a tubing (not shown) so as to allow controller 90 to be located anywhere on water gun 10. Furthermore, in accordance with various alternate embodiments of the present invention, controller 90 could have continuously variable setting levels. For example, controller 90 could be present as a continuous dial that regulates the diameter of pressure normalizer 50 (hole or one-way valve varieties). Thus, the user could rotate dial controller 90 and thereby convert pressure normalizer 50 from fully closed to openings with varying diameter lengths. Furthermore, in accordance with various alternate embodiments of the present invention, controller 90 could control the diameter of nozzle 40 with continuously variable setting levels.

Figure 7B:
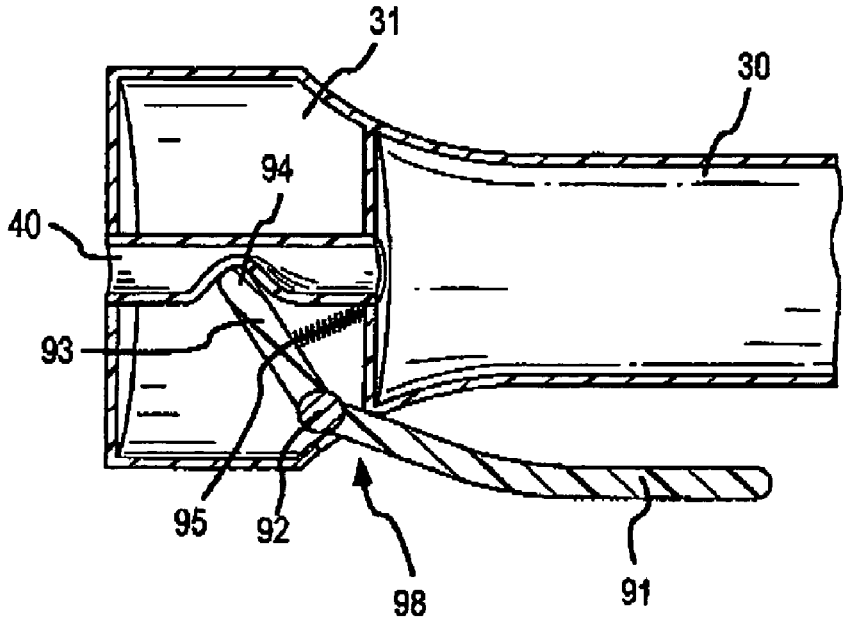

Again with reference to FIG. 7*a*, an alternate embodiment of the invention is presented utilizing a lever-based controller 90. By contracting lever 91 against neck 30 a user can open nozzle 40, allowing fluid to exit through nozzle 40. When the user releases lever 91, controller 90 automatically closes nozzle 40 and repositions lever 91. Now with reference to FIG. 7*b*, an exemplary internal configuration for lever-based controller 90 is presented. Lever 91 pivots at a pivot 92 and is attached to a shaft 93 with a stopper 94. In addition, nozzle 40 is further equipped with a flexible tube 41. When lever 91 is collapsed, a spring 95 is stretched and stopper 94 releases pressure on flexible tube 41, letting fluid 60 exit through nozzle 40. When lever 91 is released, shaft 93 is pulled by spring 95 and stopper 94 again places pressure on flexible tube 41, stopping fluid 60 from exiting through nozzle 40. However, in accordance with alternate embodiments of the present invention, controller 90 could instead utilize mechanisms such as controlled valves and various other mechanisms now known or not yet known for regulating the flow of fluid through an orifice.

Thus, while the principles of the invention have been described in illustrative embodiments, many combinations and modifications of the above-described structures, arrangements, proportions, the elements, materials, and components, used in the practice of the invention in addition to those not specifically described may be varied and particularly adapted for a specific environment and operating requirement without departing from those principles.

I claim:

1. A toy water gun, comprising: a reservoir for storing fluid; a substantially rigid neck extending from said reservoir; a nozzle located at an end of said neck, wherein when an external movement of the entire toy water gun along a lengthwise axis of said neck causes said fluid to acquire momentum in the same direction as said movement, and wherein when said movement of the toy water gun is reversed along said lengthwise axis said momentum of said fluid propels said fluid from said reservoir through said nozzle; a pressure normalizer for neutralizing a pressure change in said reservoir when said fluid is propelled through said nozzle and a controller for controlling the flow of said fluid through said nozzle wherein said controller comprises continuously variable setting levels.

2. A toy water gun, comprising: a reservoir for storing fluid; a substantially rigid neck extending from said reservoir; a nozzle located at an end of said neck, wherein when an external movement of the entire toy water gun along a lengthwise axis of said neck causes said fluid to acquire a momentum in the same direction as said movement, and wherein when said movement of the toy water gun is reversed along said lengthwise axis said momentum of said fluid propels said fluid from said reservoir through said nozzle; and a pressure normalizer for neutralizing a pressure change in said reservoir when said fluid is propelled through said nozzle, wherein said nozzle further comprises a rotatable nozzle system having a plurality of selectable nozzles.

3. A toy water gun, comprising: a reservoir for storing fluid; a substantially rigid neck extending from said reservoir; a nozzle located at an end of said neck, wherein when an external movement of the entire toy water gun along a lengthwise axis of said neck causes said fluid to acquire a momentum in the same direction as said movement, and wherein when said movement of the toy water gun is reversed along said lengthwise axis said momentum of said fluid propels said fluid from said reservoir through said nozzle; and a pressure normalizer for neutralizing a pressure change in said reservoir when said fluid is propelled through said nozzle, wherein the toy water gun is connectable with a second toy gun via a connector.

4. The toy water gun of claim 3, wherein said pressure normalizer comprises a one-way valve allowing air to enter said reservoir.

5. The toy water gun claim 3, wherein said pressure normalizer comprises pliable walls on said reservoir, and wherein said pliable walls contract as said fluid exits through said nozzle to decrease a volume of said reservoir, thereby neutralizing a pressure change in said reservoir.

6. The toy water gun of claim 3, wherein said pressure normalizer comprises a one-way valve and wherein said controller opens and closes said one-way valve, thereby controlling the amount of said fluid exiting said nozzle.

7. The toy water gun of claim 6, wherein said controller is located on said neck proximate said nozzle and wherein said controller remotely controls said one-way valve via an air tube.

8. The toy water gun of claim 3, wherein said second toy gun is a water gun of similar configuration as the toy water gun and where when the toy water guns are connected they form an integrated, double-barreled toy water gun.

9. A toy water gun, comprising: a reservoir for storing fluid; a substantially rigid neck extending from said reservoir, a nozzle located at an end of said neck, wherein when an external movement of the entire toy water gun along a lengthwise axis of said neck causes said fluid to acquire a momentum in the same direction as said movement, and wherein when said movement of the toy water gun is reversed along said lengthwise axis said momentum of said fluid propels said fluid from said reservoir trough said nozzle; and a one-way valve for neutralizing a pressure change in said reservoir when said fluid is propelled through said nozzle.

10. The toy water gun of claim 9, wherein said one-way valve is resisted.

11. The toy water gun of claim 9 wherein said reservoir further comprises a filling orifice.

12. The toy water gun of claim 11, wherein said one-way valve acts as a lid on said orifice.

13. The toy water gun of claim 9, wherein the width of said neck narrows proximate said nozzle.

14. The toy water gun of claim 9, wherein said reservoir, said neck, and said nozzle are composed of a single piece of material.

15. The toy water gun of claim 9, wherein said nozzle comprises a resisted valve.

16. The toy water gun of claim 9, wherein said neck and said reservoir are covered with an aesthetic housing.

17. The toy water gun of claim 9, wherein said water gun further comprises an orifice configured to attach to a quick-fill system.

18. The toy water gun of claim 9, further comprising a controller for controlling the flow of said fluid through said nozzle.

19. The toy water gun of claim 18, wherein said controller is located on said neck proximate to said nozzle.

20. A toy water gun, comprising: a reservoir for storing fluid; a substantially rigid neck extending from said reservoir; a nozzle located at an end of said neck, wherein when an external movement of the entire toy water gun along a lengthwise axis of said neck causes said fluid to acquire a momentum in the same direction as said movement and wherein when said movement of the toy water gun is reversed along said lengthwise axis said momentum of said fluid propels said fluid from said reservoir through said nozzle; a one-way valve for neutralizing a pressure change in said reservoir when said fluid is propelled through said nozzle; and a controller for controlling the flow of said fluid through said nozzle.

* * * * *